United States Patent [19]

Stenger

[11] Patent Number: 4,717,048

[45] Date of Patent: Jan. 5, 1988

[54] BEVERAGE TAP

[75] Inventor: Donald R. Stenger, Roscoe, Ill.

[73] Assignee: Johnson Enterprises, Inc., Rockford, Ill.

[21] Appl. No.: 840,759

[22] Filed: Mar. 18, 1986

Related U.S. Application Data

[63] Continuation-in-part of Ser. No. 729,304, May 1, 1985, abandoned.

[51] Int. Cl.[4] ..... B65D 83/00

[52] U.S. Cl. ..... 222/400.8; 137/212; 137/320; 137/322; 285/409; 285/415

[58] Field of Search ..... 222/400.7, 400.8; 137/212, 317, 320, 322; 403/344; 285/409, 415

[56] References Cited

U.S. PATENT DOCUMENTS

| | | | |
|---|---|---|---|
| 1,479,193 | 1/1924 | McSpadden | 403/344 X |
| 1,518,479 | 12/1924 | Brewer | 285/409 |
| 1,755,669 | 4/1930 | Schwab | 403/344 X |
| 3,979,143 | 9/1976 | Weinhold | 285/409 X |
| 4,305,421 | 12/1981 | Fallon | 222/400.7 X |
| 4,350,273 | 9/1982 | Nezworski et al. | 222/400.7 X |
| 4,520,954 | 6/1985 | Brown | 222/400.7 X |
| 4,612,952 | 9/1986 | Fallon | 222/400.7 X |

*Primary Examiner*—Joseph J. Rolla
*Assistant Examiner*—David H. Bollinger
*Attorney, Agent, or Firm*—Leydig, Voit & Mayer

[57] ABSTRACT

A tap for a beer keg having a Sankey-type fitting with radially inwardly extending lugs which normally are used to hold a conventional tap in a locked position on the keg. To prevent the locking lugs of the fitting from being damaged or to permit use of the keg after the lugs have become worn or damaged, the present tap includes a radially expandable and contractible collar adapted to lock onto the external lip of the fitting. The collar is formed by two camming clamps connected to swing about a hinge and adapted to float angularly relative to the body of the tap in order to permit the clamps to center themselves on the fitting. As the clamps are closed, they cam against the external lip of the fitting and force the tap downwardly to open the valves of the fitting.

13 Claims, 12 Drawing Figures

BEVERAGE TAP

CROSS-REFERENCE TO A RELATED APPLICATION

This application is a continuation-in-part of my copending application Ser. No. 729,304, filed May 1, 1985 and now abandoned.

BACKGROUND OF THE INVENTION

This invention relates to a tap for a container such as a beer keg. More specifically, the invention relates to a tap for a keg having a fitting known as a Sankey-type fitting. Such a fitting includes a tubular neck having valve means which normally close the container to hold the beer under pressure in the container. The tap includes a probe adapted to be telescoped into the neck to open the valve means and permit pressurized gas to be injected into the keg while permitting beer to be dispensed from the keg. When the tap is coupled to the fitting, the probe is automatically sealed within the neck to prevent leakage around the fitting.

In a Sankey-type fitting, locking lugs project radially inwardly from the neck. When a conventional tap is coupled to the fitting, a locking ring on the tap cams beneath the lugs when the tap is rotated through approximately one-fourth turn. The ring and lugs coact to lock the tap on the keg, to cause the probe to open the valve means and to maintain a seal between the tap and the neck.

The locking lugs of a Sankey-type fitting frequently become damaged as a result of improper installation or removal of the tap or as a result of using the tap to lift the keg. When the lugs become damaged, the entire fitting must be replaced to enable existing taps to be used and this involves significant expense.

SUMMARY OF THE INVENTION

The general aim of the present invention is to provide a new and improved tap which may be used effectively with a Sankey-type fitting but which places no reliance on the locking lugs of the fitting so that the tap will not damage the locking lugs and so that the tap may be used even on kegs with damaged lugs and thereby eliminate the need for replacing the fitting when the lugs become damaged.

A more detailed object of the invention is to achieve the foregoing by providing a tap having a unique expandable and contractible collar with camming lugs adapted to lock beneath an external lip on the neck and adapted, as an incident to being locked, to cause the probe to open the valve means while keeping the probe centered in the neck so as to enable the probe to properly open the valve means and to properly seal within the neck.

Another object of the invention is to provide a tap having an expandable and contractible collar formed by two novel clamps which are capable of floating on the body of the tap in order to enable the clamps to self-center on the outside of the neck and locate themselves properly with respect to the probe within the neck.

The invention also resides in the novel construction permitting the clamps to float relative to the tap body while restraining the clamps against rotation about the tap body and while effecting controlled opening and closing of the clamps in response to movement of an operating lever.

These and other objects and advantages of the invention will become more apparent from the following detailed description when taken in conjunction with the accompanying drawings.

DETAILED DESCRIPTION OF THE PREFERRED EMBODIMENT

Figure 1:
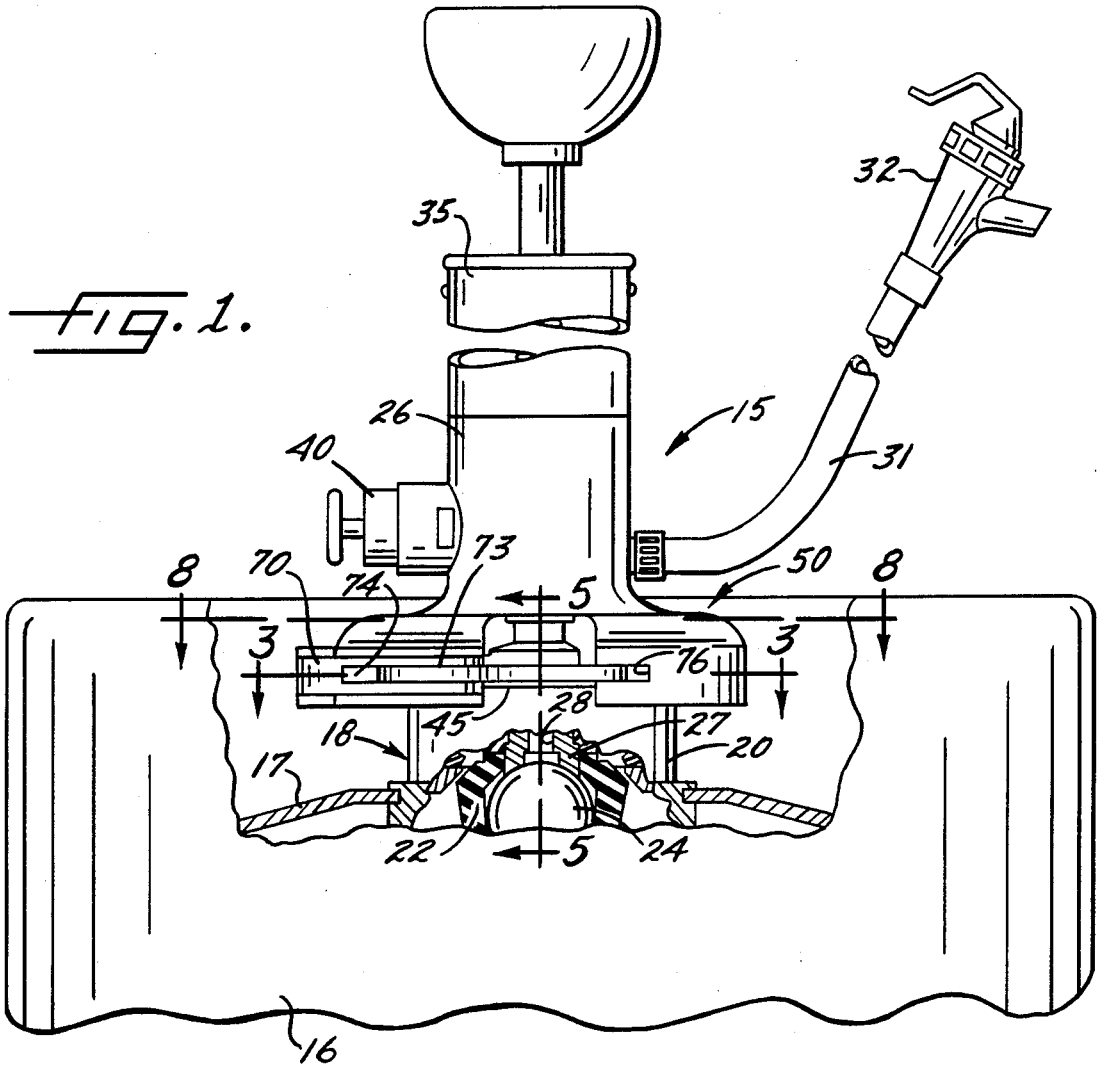
FIG. 1 is a side elevational view of a beer keg equipped with a Sankey-type fitting and equipped with a new and improved tap incorporating the unique features of the present invention, certain parts of the fitting being broken away and shown in section.

As shown in the drawings for purposes of illustration, the invention is embodied in a tap 15 for dispensing beer or other beverage from a keg 16 having the usual top wall 17. A fitting 18 (FIGS. 1 and 5) is welded into an opening in the top wall and, in this particular instance, is a fitting of the category which is known as a U.S. Sankey-type fitting, such fittings being made in the United States by Draft Systems, Inc. of Northridge, California.

The fitting 18 as such is well known and will be described only briefly herein. In general, the fitting includes a tubular neck 20 (FIG. 5) whose upper end portion projects upwardly from the top wall 17 of the keg 16 and whose lower end portion is located in the keg. A ball seat 22 made of elastomeric material is normally urged upwardly to a sealed position against the lower end of the neck by a spring (not shown). The ball seat receives a ball valve 24 which normally is urged upwardly to a closed position in the seat by a spring (not shown). When the ball is forced downwardly away from the seat, beer is permitted to flow upwardly past the ball and out of the keg 16. Opening of the ball seat 22 from the lower end of the neck 20 permits pressurized gas (either air or $CO_2$) to be introduced into the keg in order to force the beer out of the keg.

The tap 15 includes a generally cylindrical plastic body 26 whose lower end carries a probe 27 (FIGS. 5 and 10) having a central hole or passage 28 and a cross-slot 30. When the probe is inserted into the neck 20, its lower end engages the ball 24 and telescopes into the ball seat 22 to force the ball downwardly away from the seat to its open position. Beer escapes past the open ball, flows into the cross-slot 30 and then flows out of the passage 28 to a beer line 31 (FIG. 1) connected into the tap body 26 and carrying a dispensing faucet 32. An elastomeric washer 33 (FIG. 5) on the lower end portion of the probe 27 engages the upper end of the ball seat 22 shortly after the probe opens the ball 24. The washer seals against the top of the valve seat 22 while pushing the ball seat downwardly from the lower end of the neck 20 to permit pressurized gas to be injected into the keg.

Figure 6:
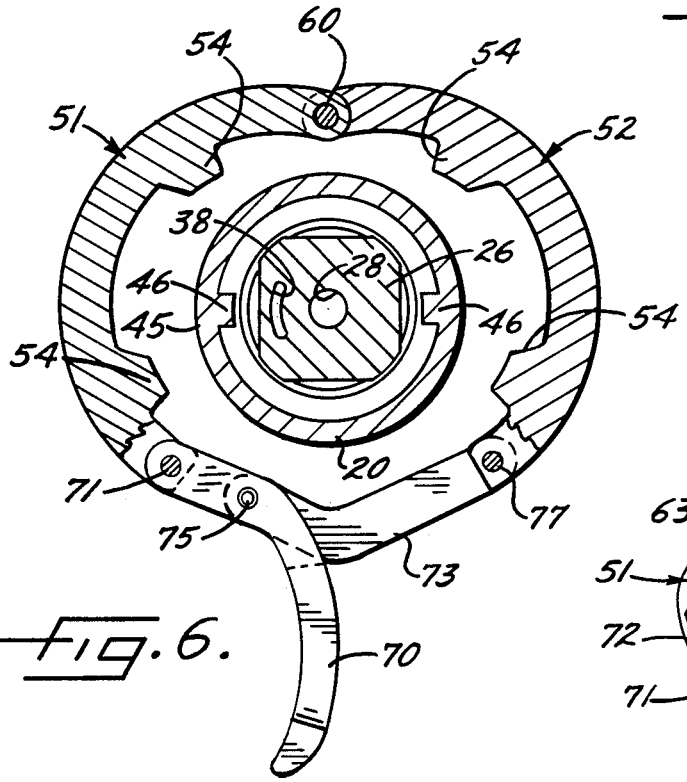
FIG. 6 is a view similar to FIG. 3 but shows the tap in a released position relative to the fitting.
Figure 7:
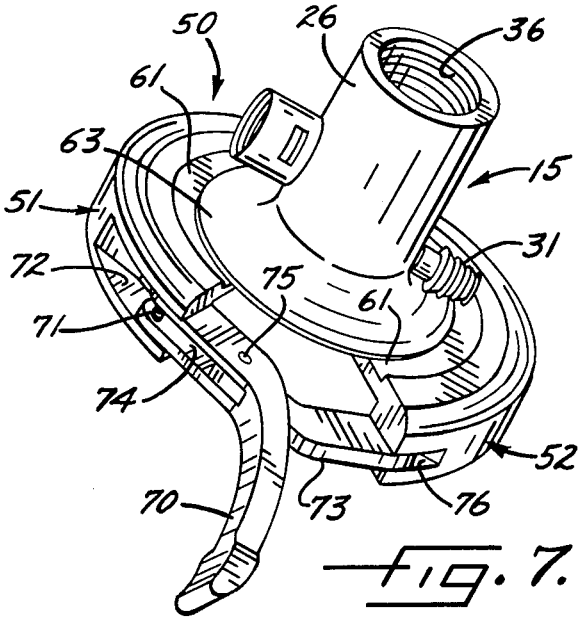
FIG. 7 is a perspective view of the tap.

In the present instance, pressurized air is introduced into the keg 16 by means of a reciprocating hand-operated pump 35 (FIG. 1) whose lower end is adapted to be screwed into a threaded opening 36 (FIG. 7) in the upper end of the tap body 26. When the pump is operated, pressurized air is forced downwardly through a passage 38 (FIGS. 5 and 6) in the body and flows into the keg via the annular gap between the open ball seat 22 and the lower end of the neck 20. A check valve (not shown) prevents beer from flowing into the pump 35 while a relief valve 40 in the side of the tap body prevents over-pressurization of the keg.

In order to prevent fluid from leaking between the tap 15 and the fitting 18, the lower end portion of the tap body 26 carries an annular skirt 42 (FIGS. 5 and 10) which is made of elastomeric material and which is adapted to seal against the inside of the neck 20. The skirt is sized to be pressed into sealing engagement with the inside of the neck 20.

Figure 2:
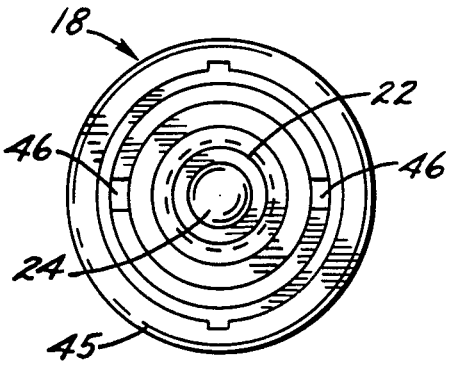
FIG. 2 is a top plan view of the fitting shown in FIG. 1.
Figure 4:
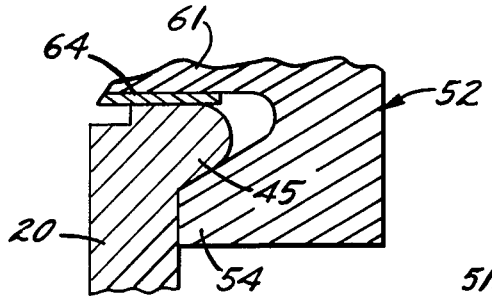
FIG. 4 is an enlarged fragmentary cross-section taken substantially along the line 4—4 of FIG. 3 and shows the tap in a locked position relative to the fitting.

As shown in FIGS. 2 and 4, a radially outwardly extending peripheral lip 45 is formed around the upper end of the neck 20, the lip typically coacting with keg cleaning and filling equipment at the brewery. In addition, two diametrically spaced locking lugs 46 (FIGS. 2 and 5) project radially inwardly into the neck 20. When a conventional tap is used with the keg 16, a locking ring on the lower end portion of the tap interlocks with the lugs 46 when the tap is rotated through approximately one-fourth turn. The locking action effected by the lugs 46 coacting with the ring secures the tap tightly to the keg and establishes a tight seal between the neck 20 and a skirt similar to the skirt 42.

When the lugs 46 become worn or damaged, they no longer can effectively coact with the locking ring of a conventional tap and thus the fitting 18 must be replaced in order to enable conventional taps to be used with the keg 16. In accordance with the present invention, the tap 15 is provided with a unique expandable and contractible camming collar 50 adapted to lock onto and seal with the fitting 18 and adapted to cause the ball 24 and the ball seat 22 to open without need of relying on the lugs 46. As a result, the tap 15 of the invention may be used with kegs having fittings with damaged lugs and thus there is no need to replace the relatively expensive fittings. In addition, the tap does not cause any damage to lugs which are in good condition.

More specifically, the expandable and contractible collar 50 is formed by a pair of clamps 51 and 52 adapted to be moved between open and closed positions. The clamps are closed just after the lower end portion of the tap body 26 and the sealing skirt 42 have been inserted into the neck 20 and just after the probe 27 has contacted the ball 24 (see FIG. 11). As the clamps are closed, lugs 54 (FIGS. 3, 4, 6 and 11) on the clamps cam downwardly beneath the outwardly projecting lip 45 on the neck 20 to force the ball 24 downwardly from the ball seat 22 and to force the ball seat downwardly from the lower end of the neck and, at the same time, to lock the tap 15 to the neck. During such locking, the clamps float relative to the tap body 26 and center themselves automatically on the neck so as to securely grip the neck without disturbing the centered relationship of the probe 27 and the sealing skirt 42 with the ball seat and the neck.

In the present instance, each of the clamps 51, 52 is made of plastic and each is generally semi-circular in shape. One end of the clamp 51 is formed with a circumferentially extending ear 55 (FIG. 10) which projects into a slot 56 defined between a pair of circumferentially extending and axially spaced ears 57 formed on the adjacent end of the clamp 52. A roll pin 60 extends through holes in the ears 55 and 57 and defines a vertically extending hinge which connects the clamps for swinging between their open and closed positions. The hinge pin 60 is not directly connected to the tap body 26.

Figure 5:
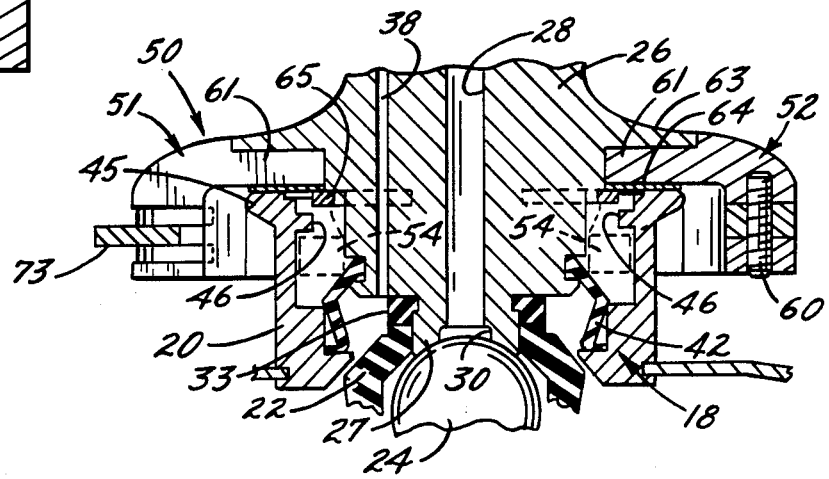
FIG. 5 is an enlarged fragmentary cross-section taken substantially along the line 5—5 of FIG. 1 and shows the tap in a locked position relative to the fitting.
Figure 10:
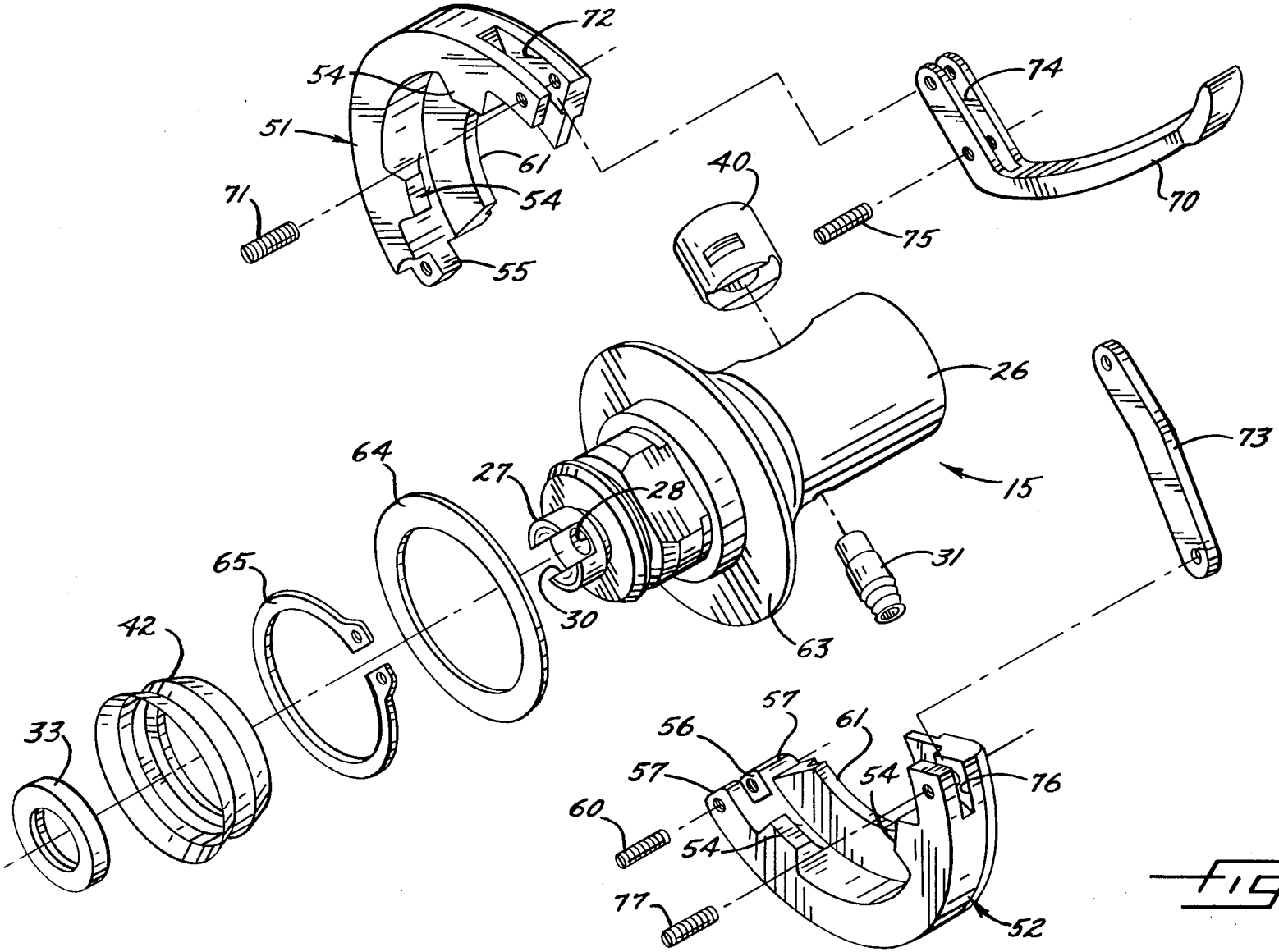
FIG. 10 is an exploded perspective view of certain parts of the tap.

To captivate the clamps 51 and 52 axially on the tap body 26, each clamp is formed with a radially inwardly projecting and substantially continuous flange 61 (FIGS. 5 and 10). The flanges 61 are sandwiched slidably between a radially extending collar 63 and a washer 64 which is spaced below the collar. The collar 63 is formed integrally with the tap body 26 while the washer 64 is captivated on the body by a snap ring 65. The collar and the washer captivate the clamps 51 and 52 axially and help guide the flanges of the clamps to slide inwardly and outwardly when the clamps are closed and opened.

In order to swing the clamps 51 and 52 between their open and closed positions, an arcuate lever or handle 70 is pivotally connected by a pin 71 to the end portion of the clamp 51 opposite the ear 55, such end portion being formed with a slot 72 (FIGS. 7 and 10) for receiving the handle. One end portion of a link 73 fits into a slot 74 (FIGS. 7 and 10) formed in the pivoted end portion of the handle and is pivotally connected to the handle between the ends thereof by a pin 75. The other end portion of the link 73 fits into a slot 76 formed in the end of the clamp 52 opposite the ears 57 and is connected pivotally to the clamp by a roll pin 77.

Figure 3:
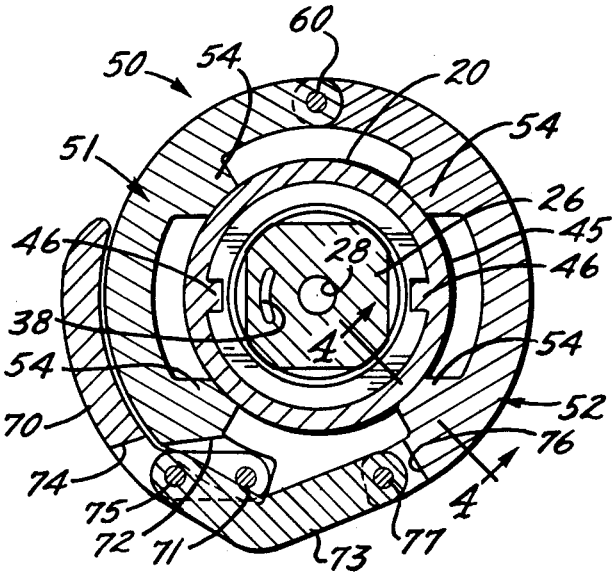
FIG. 3 is a cross-section taken substantially along the line 3—3 of FIG. 1 and shows the tap in a locked position relative to the fitting.
Figure 8:
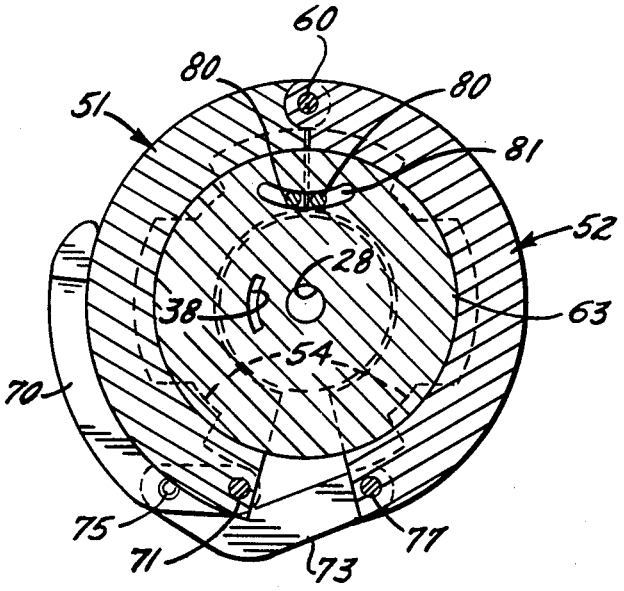
FIG. 8 is a cross-section taken substantially along the line 8—8 of FIG. 1 and shows the tap in a locked position relative to the fitting.
Figure 9:
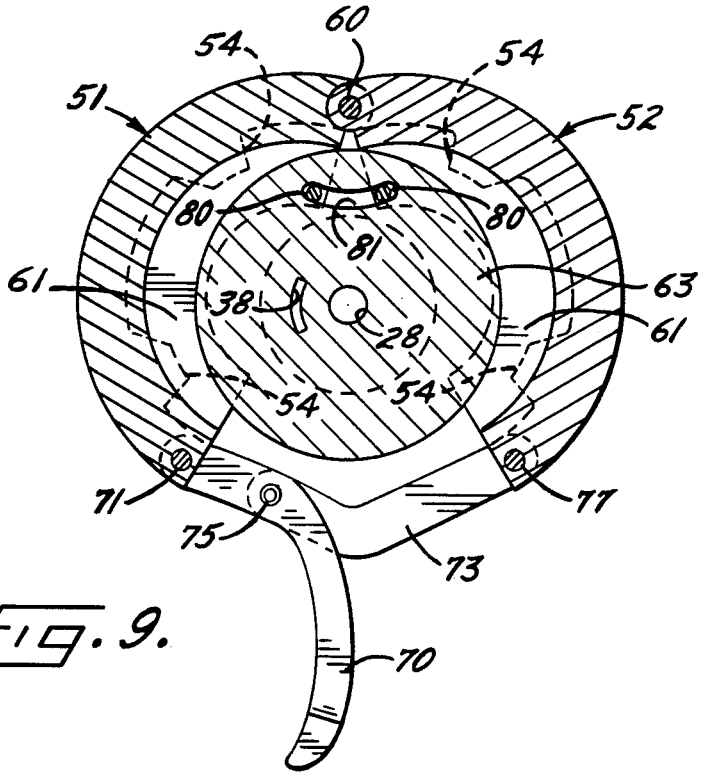
FIG. 9 is a view similar to FIG. 8 but shows the tap in a released position relative to the fitting.

When the clamps 51 and 52 are in their locked positions, the inner side of the handle 70 lies compactly alongside the outer side of the clamp 51 as shown in FIGS. 3 and 8. When the handle is so positioned, the link 73 acts with a toggle action to hold the handle in its closed position and to keep the clamps in their locked positions. When the handle is swung outwardly, it acts directly on the clamp 51 and acts on the clamp 52 by way of the link 73 to swing the clamps in opposite directions about the hinge pin 60 and thereby expand the clamps to their open positions (FIGS. 6 and 9) to cause the lugs 54 to release the lip 45.

As the clamps 51 and 52 are closed, the lugs 54 cam beneath the lip 45 on the neck 20 to lock the tap securely to the lip (see FIG. 4). Herein, each clamp includes two angularly spaced lugs 54 which project generally radially inwardly from the clamp and which are spaced below the flange 61 thereof. When the clamps are closed, the lugs 54 cam beneath the lip 45 while the flanges 61 move above the lip and the washer 64 as shown in FIG. 4. Importantly, the upper surfaces of the lugs are inclined downwardly and inwardly at an angle of about 30 degrees and define cam surfaces which coact with the similarly inclined underside of the lip to lock the tap 15 to the neck 20 as the clamps are swung to their closed positions.

Figure 11:
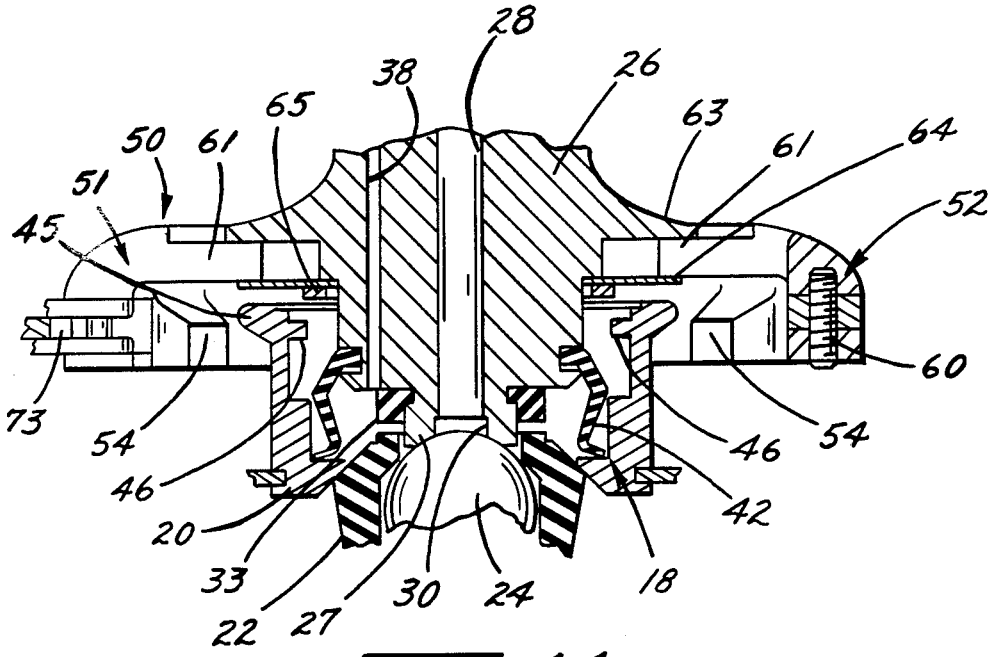
FIG. 11 is a view similar to FIG. 5 but shows the tap in a released position relative to the fitting.
Figure 12:
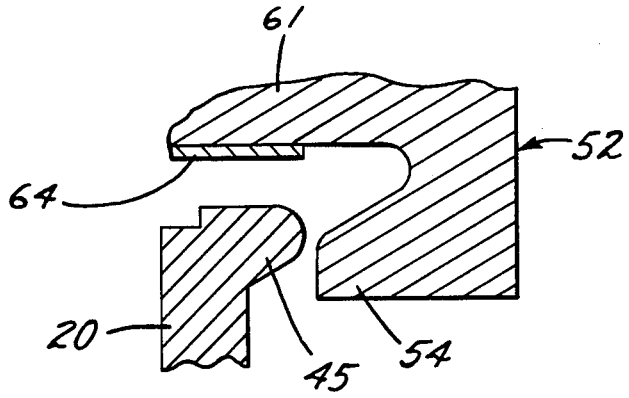
FIG. 12 is a view similar to FIG. 4 but shows the tap in a released position relative to the fitting.

The lugs 54 are positioned relative to the lip 45 of the neck 20 in the manner shown in FIGS. 11 and 12 just after the probe 27 has been inserted into the neck and prior to the time the clamps 51 and 52 are closed. In this position, the probe 27 is spaced above or is just slightly touching the ball 24; the washer 33 is spaced above the ball seat 22; and the washer 64 is spaced above the top of the lip 45. Accordingly, the ball 24 and the ball seat 22 stay closed to prevent the leakage of fluid.

As the clamps 51 and 52 are closed, the inclined upper surfaces of the lugs 54 cam against the inclined underside of the lip 45 and force the tap body 26 downwardly relative to the neck 20. As a result, the probe 27 engages the ball 24 to force the ball downwardly away from the ball seat 22 and open the beer passage. Shortly thereafter, the washer 33 seals against the ball seat 22 and, with continued closing of the clamps and continued downward movement of the tap body, the washer pushes the ball seat downwardly away from the lower end of the neck 20 to open the air passage. Thus, the downward camming action effected by the lugs 54 during closing of the clamps serves to automatically unseat the ball 24 and to open the ball seat 22.

Further in carrying out the invention, the clamps 51 and 52 are adapted to swing toward their closed positions and lock beneath the lip 45 without disturbing the centered relationship of the probe 27 and the sealing skirt 33 with the ball seat 22 and the neck 20. For this purpose, the clamps 51 and 52 and the hinge pin 60 are not connected directly to the tap body 26 but instead the clamps are permitted to float angularly through a limited range relative to the body so that the clamps may seek centered positions on the neck 20 while the probe 27 is centered in the valve seat 22. When the clamps are closed, the floating action allows one clamp to engage and lock against the lip 45 prior to the time the other clamp engages the lip. In this way, each clamp may lock onto the lip substantially independently of the other clamp so as to avoid the need of maintaining a precisely centered relationship between the clamps and the probe 27 as the clamps are closed and also to allow the clamps to lock onto a lip which is not precisely centered with respect to the ball seat 22.

To control the floating clamps 51 and 52, the flange 61 of each clamp carries a guide pin 80 (FIGS. 8 and 9) near the end of the flange located adjacent the hinge pin. The two guide pins project into a slot 81 formed in the lower side of the collar 63. The slot is curved arcuately about an axis which coincides with the axis of the hinge pin 60 when the latter is positioned with the clamps fully closed and centered relative to the probe 27. As the clamps are opened and closed, the guide pins 80 travel within the slot 81 between the positions shown in FIGS. 8 and 9 and confine angular floating of the clamps to a limited range so as to prevent the clamps from floating any substantial distance around the tap body 26. For example, when the tap body 26 is held in one hand and the handle 70 is pushed with the other hand to close the clamps, the pins prevent the clamps from rotating about the axis of the tap body. The guide pins do not, however, interfere with the normal opening and closing motion of the clamps nor do they interfere with the ability of the clamps to float to the extent necessary to permit self-centering of the clamps.

From the foregoing, it will be apparent that the present invention brings to the art a new and improved tap 15 which is capable of locking onto the external lip 45 of a Sankey-type fitting 18 and which places no reliance on the normal internal locking lugs 46 of the fitting. As a result, expensive fittings with damaged lugs need not be replaced but instead may remain in service simply by using the tap of the present invention in conjunction with the keg. The tap can, of course, be used with fittings having undamaged locking lugs or having no locking lugs at all and thus the tap is capable of universal use on Sankey-type fittings and other fittings of the same general category. When the tap is used on a fitting having lugs in good condition, there is no danger of the tap causing damage to the lugs.

I claim:

1. A tap for a container having an upstanding tubular neck with a radially outwardly projecting peripheral lip at its upper end, the inside of said neck having normally closed valve means which may be opened to permit pressurized fluid to be introduced into said conatiner and to permit liquid to flow out of said container, said tap comprising a body initially spaced upwardly from said lip and having lower probe means sized for downward insertion into said neck and adapted to open said valve means as an incident to being inserted fully into said neck, said probe means being fixed relative to said body, passages in said body for introducing pressurized fluid into the container and for delivering liquid out of the container when said valve means are open, and means for releasably fastening said tap to said neck, said tap being characterized in that said fastening means comprise an expandable collar on said body and having angularly spaced and generally radially inwardly projecting cam lug means, and means for contracting and expanding said collar between a locked position in which said lug means lock beneath said lip to keep said probe means in said neck and a released position in which said lug means are spaced outwardly from said lip to permit said probe means to be pulled out of said neck, said lug means being shaped to cam against the lower side of said lip and draw said tap body downwardly toward said neck sufficiently far to cause said probe means to be fully inserted into said neck and open said valve means as said collar is contracted to said locked position and without need of rotating said tap body relative to said neck.

2. A tap for a container having an upstanding tubular neck with a radially outwardly projecting peripheral lip at its upper end, the inside of said neck having normally closed valve means which may be opened to permit pressurized fluid to be introduced into said container and to permit liquid to flow out of said container, said tap comprising a body initially spaced upwardly from said lip and having a lower probe sized for downward insertion into said neck and adapted to open said valve means as an incident to being inserted fully into said neck, passages in said body for introducing pressurized fluid into the container and for delivering liquid out of the container when said valve means are open, said means for releasably fastening said tap to said neck, said tap being characterized in that said fastening means comprise an expandable collar on said body and having angularly spaced and generally radially inwardly projecting cam lug means, and means for contracting and expanding said collar between a locked position in which said lug means lock beneath said lip to keep said probe in said neck and a released position in which said lug means are spaced outwardly from said lip to permit said probe to be pulled out of said neck, said lug means being shaped to cam against the lower side of said lip and draw said probe downwardly sufficiently far so as to be inserted fully into said neck to open said valve means as said collar is contracted to said locked position and without need of rotating said tap body relative to said neck.

3. A tap as defined in claim 2 in which said collar comprises a pair of generally semi-circular clamps each having at least one of said lug means, a vertical hinge connecting two of the adjacent ends of said clamps to one another to permit said clamps to swing between said locked and released positions, and manually operable means connected between the other two adjacent ends of said clamps for swinging both of said clamps about said hinge between said locked and released positions.

4. A tap as defined in claim 3 in which said manually operable means comprise a lever having one end connected pivotally to the end of one of said clamps, a link having one end connected pivotally to the adjacent end of the other clamp, and means pivotally connecting the other end of said link to said lever intermediate the end thereof.

5. A tap as defined in claim 3 in which said tap includes means for captivating said clamps axially relative to said body while permitting said clamps to swing relative to said body.

6. A tap as defined in claim 5 in which said clamps are free to float angularly through a limited range relative to said body.

7. A tap as defined in claim 6 further including means connected between said clamps and said body and guided to travel in a path curved arcuately about the axis of said hinge, said last-mentioned means confining angular floating of said clamps to said limited range.

8. A tap as defined in claim 2 in which said collar comprises a pair of clamps each having at least one of said lug means, a vertical hinge connecting two of the adjacent ends of said clamps to one another to permit said clamps to swing between said locked and released positions, said clamps being free to float angularly relative to said body.

9. A tap as defined in claim 2 in which said lug means include downwardly and inwardly inclined upper surfaces.

10. A tap for a container having an upstanding tubular neck with a radially outwardly projecting peripheral lip at its upper end, the inside of said neck having normally closed valve means which may be opened to permit pressurized fluid to be introduced into said container and to permit liquid to flow out of said container, said tap comprising a body having a lower probe sized for downward insertion into said neck and adapted to open said valve means as an incident to being fully inserted into said neck, passages in said body for introducing pressurized fluid into the container and for delivering liquid out of the container when said valve means are open, a seal on the lower end portion of said body and adapted to telescope into and seal against the inside of the neck when said probe is inserted fully into said neck and said valve means are open, and means for releasably fastening said tap to said neck, said tap being characterized in that said fastening means comprise a pair of generally semicircular clamps, a vertical hinge free of a direct connection with said body and connecting two of the adjacent ends of said clamps to one another to permit said clamps to swing between locked and released positions, means for captivating said clamps on said body while permitting said clamps to swing about said hinge and while permitting said clamps to float angularly through a limited range relative to said body thereby to enable said clamps to center themselves on said neck when said clamps are swung to said locked positions, said clamps being locked beneath said lip when in locked positions and being spaced outwardly from said lip when in said released positions, and manually operable means connected between the other two adjacent ends of said clamps for swinging both of said clamps about said hinge and between said locked and released positions.

11. A tap as defined in claim 10 in which said captivating means comprise pins extending between said clamps and said body and movable with said clamps, and a slot formed in said body and receiving said pins, said slot being curved arcuately about the axis of said hinge.

12. A tap as defined in claim 11 in which said captivating means further include flanges on said clamps, and axially spaced means on said body and receiving said flanges, said axially spaced means permitting said flanges to move angularly while captivating said flange axially.

13. A tap as defined in claim 10 in which said clamps are formed with lugs having downwardly and inwardly inclined upper surfaces shaped to cam against said lip and shift said tap body downwardly as said clamps are swung to said locked positions.

* * * * *